US006356010B1

(12) United States Patent
Nakamura

(10) Patent No.: US 6,356,010 B1
(45) Date of Patent: Mar. 12, 2002

(54) COLOR PICTURE TUBE HAVING A SHADOW MASK WITH SPECIFIED RESONANCE FREQUENCY PARAMETERS

(75) Inventor: Koji Nakamura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/327,623

(22) Filed: Jun. 8, 1999

(30) Foreign Application Priority Data

Jun. 18, 1998 (JP) ..... 10-171015
Sep. 25, 1998 (JP) ..... 10-271659

(51) Int. Cl.[7] ..... H01J 29/80

(52) U.S. Cl. ..... 313/402; 313/403; 313/407; 313/404

(58) Field of Search ..... 313/402–408

(56) References Cited

FOREIGN PATENT DOCUMENTS

| | | |
|---|---|---|
| JP | A 55 154040 | 12/1980 |
| JP | Y2 58 26445 | 6/1983 |
| JP | Y2 58 47639 | 10/1983 |
| JP | A 61 240531 | 10/1986 |
| JP | B2 687395 | 11/1994 |
| JP | A 9 45258 | 2/1997 |

*Primary Examiner*—Vip Patel
*Assistant Examiner*—Mack Haynes

(57) ABSTRACT

A color picture tube has a face panel, an electron gun, a deflection yoke, a shadow mask, a frame for supporting the shadow mask, and a support member for supporting the frame on the face panel, wherein $\omega_v$ denotes a vertical scan frequency by the deflection yoke, n denotes an arbitrary integer which satisfies $1 \leqq n \leqq 6$, N denotes an arbitrary integer which satisfies $1 \leqq N \leqq 6$, ω denotes a frequency which satisfies $\omega = \omega_v * n/N$, $\omega_s$ denotes a resonant frequency of the shadow mask, and the frame, the support member, and the shadow mask are constructed such that the resonant frequency $\omega_s$ assumes a value other than the frequency ω.

20 Claims, 12 Drawing Sheets

ωc : HIGH CONTRAST RESONANT FREQUENCY

COLOR PICTURE TUBE HAVING A SHADOW MASK WITH SPECIFIED RESONANCE FREQUENCY PARAMETERS

BACKGROUND OF THE INVENTION

The present invention relates to a color picture tube having a shadow mask, and in particular, to a structure of the color picture tube, which is designed to alleviate a degradation in image quality which is attributable to oscillations and impacts.

A color picture tube generally comprises a face panel carrying a fluorescent screen, and a shadow mask disposed in opposing relationship with the fluorescent screen and acting as a color selection member. A given positional relationship is maintained between three color phosphors (for example, phosphor stripes), constituting together the fluorescent screen, and openings (or slits) in the shadow mask. Three electron beams emitted from an electron gun are scanned in both horizontal and vertical directions, and can irradiate corresponding color phosphors only when they are allowed to pass through the opening in the shadow mask.

When the above-mentioned color picture tube is subject to oscillations or impacts, the positional relationship between the phosphors and the openings in the shadow mask changes to prevent a proper irradiation of the phosphors by the electron beams as long as the oscillations continue. This presents problems of producing a faint color area in an image being displayed (in other words, displaying uneven color image due to a local reduction in the luminance of an image being displayed) and a color shift as a result of an irradiation by an electron beam of an adjacent phosphor of a different color. A shadow mask of aperture grille type (hereinafter referred to as aperture grille), in particular, is susceptible to oscillations because of its structure in which opposite ends of strips are welded to a frame in order to hold a plurality of strips (i.e., long and narrow piece) taut. Consequently, a color picture tube employing an aperture grille has been liable to a degradation in image quality which is attributable to oscillations and impacts. As one remedy which is intended to suppress oscillations of strips, a pair of damper wires are used in combination with damper springs which support the damper wires. However, for use as a monitor internally housing a loudspeaker or an aircraft onboard color picture tube, the oscillation resistance achieved has been less than satisfactory in certain instances.

It is an object of the present invention to provide a color picture tube which is less susceptible to a degradation in image quality if subjected to oscillations or impacts.

SUMMARY OF THE INVENTION

According to one aspect of the present invention, a color picture tube comprises: a face panel which is provided with a fluorescent screen; an electron gun for emitting an electron beam; means for scanning the electron beam in a horizontal and a vertical direction; a shadow mask having a plurality of openings and disposed in opposing relationship with the fluorescent screen; a frame for supporting the shadow mask; and a support member for supporting the frame on the face panel; wherein $\omega_v$ denotes a vertical scan frequency by the means for scanning, n denotes an arbitrary integer which satisfies $1 \leqq n \leqq 6$, N denotes an arbitrary integer which satisfies $1 \leqq N \leqq 6$, $\omega$ denotes a frequency which satisfies $\omega = \omega_v * n/N$, $\omega_s$ denotes a resonant frequency of the shadow mask, and the frame, the support member, and the shadow mask are constructed such that the resonant frequency $\omega_s$ assumes a value other than the frequency $\omega$.

According to another aspect of the present invention, a color picture tube comprises: a face panel which is provided with a fluorescent screen; an electron gun for emitting an electron beam; means for scanning the electron beam in a horizontal and a vertical direction; a shadow mask having a plurality of openings and disposed in opposing relationship with the fluorescent screen; a frame for supporting the shadow mask; and a support member for supporting the frame on the face panel; wherein $\omega_v$ denotes a vertical scan frequency by the means for scanning, n denotes an arbitrary integer which satisfies $1 \leqq n \leqq 6$, N denotes an arbitrary integer which satisfies $1 \leqq N \leqq 6$, $\omega$ denotes a frequency which satisfies $\omega = \omega_v * n/N$, $\omega_s$ denotes a resonant frequency of the shadow mask, and the frame, the support member and the shadow mask are constructed such that resonant frequency $\omega_s$ assumes a value other than frequency $\omega$ and rise in a frequency band defined a pair of adjacent frequency values from a series of frequency values $\omega$.

According to a further aspect of the present invention, a color picture tube comprises: a face panel which is provided with a fluorescent screen; an electron gun for emitting an, electron beam; means for scanning the electron beam in a horizontal and a vertical direction; an aperture grille including a plurality of strips disposed in an array and separated from each other by a slit and disposed in opposing relationship with the fluorescent screen; and a frame supported by the face panel for supporting the plurality of strips of the aperture grille at an end thereof; wherein each strip of the aperture grille has a widened part at an end of the strip.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
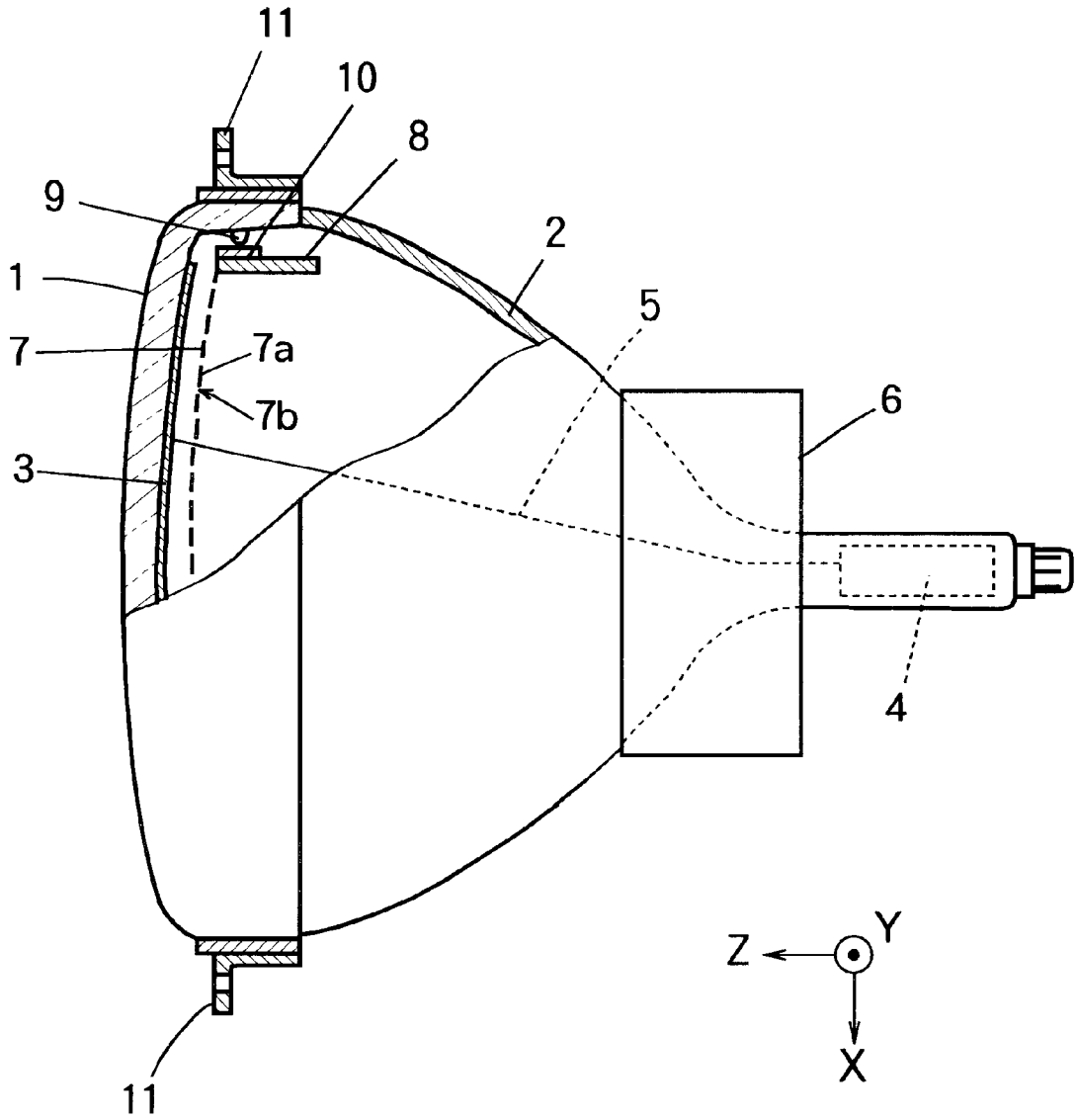
FIG. 1 is a plan view, partly broken away, schematically showing a color picture tube according to a first embodiment of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

When a color picture tube is used as a display onboard a road vehicle or an aircraft, oscillational energy is transmitted, for example, in the sequence of a cabinet, ears provided for mounting the color picture tube, a face panel of the color picture tube, pins projecting from the internal surface of the face panel, a leaf spring engaged by the pins, a frame supported by the leaf spring, and a shadow mask supported by the frame. Oscillations, which the shadow mask is subject to, change the positional relationship between the three color phosphors which constitute together the fluorescent screen and openings of the shadow mask, and as long as oscillations persist, the electron beams cannot properly irradiate the phosphors, causing a degradation in image quality such as a color unevenness or color shift.

To alleviate a degradation in image quality, in accordance with the present invention, the following approaches are employed:

Approach (1): to use a construction which is less susceptible to propagation of oscillations to the shadow mask as by increasing the number of leaf springs to make the resonant frequency of the shadow mask offset from the resonant frequency of the face panel;

Approach (2): to use a construction for the shadow mask itself which resists being oscillated by providing widened areas on the strips of the aperture grille to minimize the amplitude of oscillations in the strips; and Approach (3): to establish the resonant frequency of the shadow mask into a frequency band where the image quality is less influenced (that is, where the influence upon the image quality is less noticeable), by adjusting tension of the strips of the aperture grille.

In color picture tubes of embodiments to be described below, the approach (1) is adopted together with the approach (3) in order to supplement the effect brought forth by the approach (3). The approach (2) may be used alone to obtain advantages, but it is more desirable to adopt it in combination with the approach (3) in order to enhance the effect of the approach (3). It is noted however that an effective remedy to guard against oscillations depend on a variety of factors including the type of the color picture tube, the environment in which the color picture tube is installed, the performance required for the color picture tube, and the like. Accordingly, the use of a single approach may not achieve a satisfactory effect of alleviating a degradation in image quality, and hence it is desirable that the approaches (1) to (3) be applied in a suitable combination in consideration of the factors mentioned above.

The purpose of the approach (3) is to make a degradation in image quality which is attributable to oscillations of the shadow mask less noticeable by establishing a given relationship between the resonant frequency of the shadow mask and the vertical scan frequency of the color picture tube. The reason why the vertical scan frequency is taken into consideration will be described for the use of an aperture grille. When the aperture grille is subject to oscillations, a viewer may perceive a degradation in image quality such as a variation in the luminance, for example. This is not a result of the viewer perceiving oscillations of strips themselves contained in the aperture grille, but is a result of the viewer perceiving an oscillation of regions on the fluorescent screen which are irradiated by the electrons beams in a manner corresponding to apertures in the aperture grille (or shadows of strips in the aperture grille). In an actual system, a raster is formed at the horizontal and the vertical scan frequency. In a progressive scan (sequential scan), an image is produced every period of the vertical scan, and thus it may be said that the viewer watches the image through a filter having a raster scan frequency. A horizontal scan frequency of a color picture tube is generally chosen to be not less than 15 kHz, and the viewer is incapable of perceiving any change in the image which occurs at such a high frequency. For these reasons, when considering the influence of oscillations, which the shadow mask is subject to, upon the image quality, it is normally sufficient to take the vertical scan frequency into consideration, without the need to consider the horizontal scan frequency.

First Embodiment

A color picture tube according to a first embodiment is an example of application of the above-mentioned approach (3). However, it should be understood that the approach (3) may be adopted in combination with either one or both of the approaches (1) and (2).

(Explanation For Arrangement and Operation Of The Color Picture Tube)

FIG. 1 is a plan view, partly broken away, schematically showing the arrangement of the color picture tube according to the first embodiment of the present invention. As shown in FIG. 1, the color picture tube of the first embodiment comprises a face panel 1 formed of glass and forming part of an envelope, a funnel 2 which defines the envelope together with the face panel 1, a fluorescent screen 3 formed by an array of red, blue, and green phosphors, which may be in the form of stripes, for example, and disposed on the internal surface of the face panel 1, an electron gun 4 which emits electron beams 5, and a deflection yoke 6 which scans the electron beams 5 in both horizontal and vertical directions. In addition, the color picture tube of the first embodiment comprises an aperture grille 7 disposed in opposing relationship with the fluorescent screen 3 and including a plurality of slits (or openings) 7*b* to serve as a shadow mask, a frame 8 for supporting the aperture grille 7, and a plurality of leaf springs (only one leaf spring 10 being shown in FIG. 1) engaged with a plurality of pins (only one being shown at 9 in FIG. 1) fixedly mounted on the internal surface of the face panel 1 to support the frame 8. It will be noted in FIG. 1 that ears 11 are formed on the color picture tube to allow it to be mounted on a cabinet (not shown). In FIG. 1, symbols X, Y, and Z represent a horizontal direction, a vertical direction, and a tube axis direction, respectively.

Figure 2A:
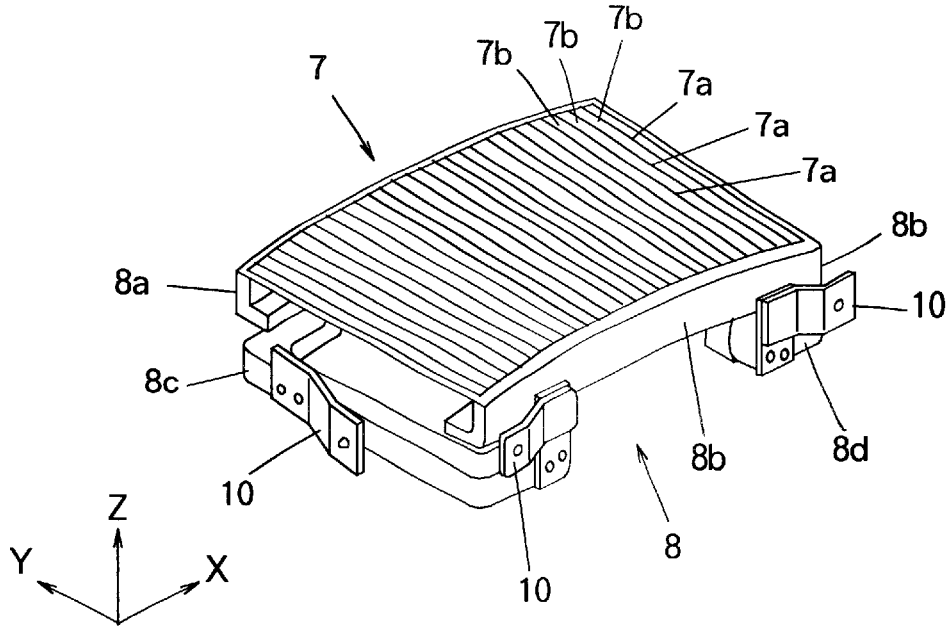
FIG. 2A is a perspective view schematically showing an aperture grille and a frame of the color picture tube shown in FIG. 1.
Figure 2B:
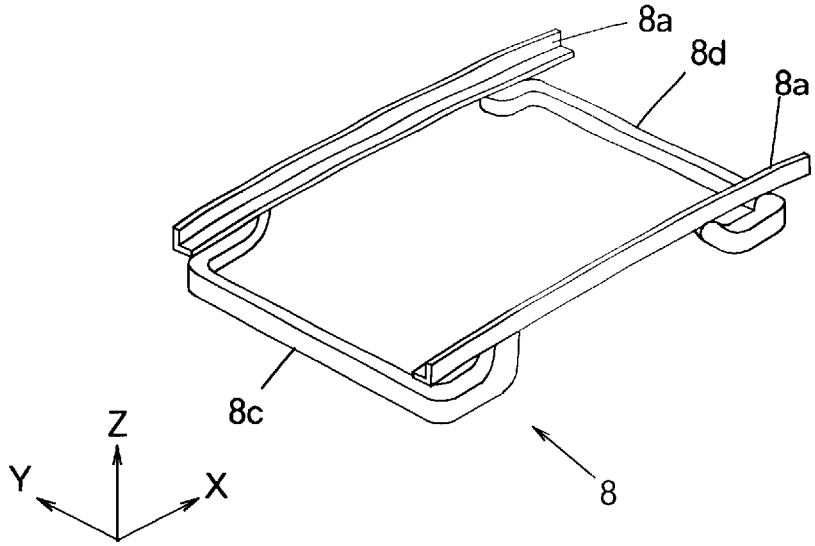
FIG. 2B is a perspective view schematically showing the frame of FIG. 2A.

FIG. 2A is a perspective view schematically illustrating the aperture grille and the frame of the color picture tube of FIG. 1, and FIG. 2B is a perspective view schematically showing the frame of FIG. 2A. As shown in FIG. 2B, the frame 8 comprises a pair of horizontal members 8*a* and 8*b* used to secure ends of a plurality of strips 7*a* used in the aperture grille 7, and a pair of vertical members 8*c* and 8*d* which are interconnected between the pair of horizontal members 8*a* and 8*b*. Both the horizontal members 8*a* and 8*b* and the vertical members 8*c* and 8*d* are formed of a steel material of a light weight such as stainless steel (SUS), for example. As shown in FIG. 2A, the aperture grille 7 includes a plurality of strips 7*a*, each in the form of a long and narrow tape, disposed in an array and separated by a slit 7*b* therebetween. The ends of the plurality of strips 7*a* of the aperture grille 7 are secured to the horizontal members 8*a* and 8*b*. Each of the strips 7*a* may comprise 0.1 mm thick rimmed steel, for example, and has its opposite ends welded to the horizontal members 8*a* and 8*b* while maintaining it in tensioned condition. It will be noted from FIG. 2A that the aperture grille 7 is not provided with damper wires and damper springs which support the damper wires for both reasons that the structure disclosed herein is capable of alleviating a degradation in image quality which is attributable to oscillations and that the provision of damper wires each disposed in contact with the strip 7*a* of the aperture grille 7 may have an adverse influence in that oscillations are transmitted between the strips 7*a* through the damper wires. However, it should be understood that the present invention is also applicable to a color picture tube which is provided with such damper wires and damper springs.

A high vacuum is maintained inside the envelope defined by the face panel 1 and the funnel 2, and a part of the electron beams 5 emitted from the electron gun 4 which has passed through the slit 7*b* in the aperture grille 7 impinges upon the fluorescent screen 3 disposed on the internal surface of the face panel 1 to which a high voltage is applied. It is to be noted that during the passage of the electron beams 5, a horizontal and a vertical deflection magnetic field each having a horizontal scan period of 30 kHz and a vertical scan period of 60 Hz, for example, is applied to the electron beams 5 from the deflection yoke 6. The electron beams 5 are deflected simultaneously in both horizontal and vertical directions, whereby an image display region, referred to as a raster, is defined on the fluorescent screen 3. In the image display region of the fluorescent screen 3, a luminescence occurs from each of the red, blue, and green phosphors with a luminous intensity which depends on the amount of the electron beam 5 which impinges thereon. By observing the distribution of the luminous intensity from outside the face panel 1, a viewer recognizes an image being displayed.

In the color picture tube of the first embodiment, denoting a vertical scan frequency of the deflection yoke 6 by $\omega_v$, an integer which satisfies $1 \leqq n \leqq 7$ by n, an integer which satisfies $1 \leqq N \leqq 7$ by N, a resonant frequency of the aperture grille 7 by $\omega_s$ and defining a frequency $\omega$ which satisfies $\omega = \omega_v * n/N$, in the color picture tube of the first embodiment, the frame 8, the leaf springs 10, and the aperture grille 7 are structured so that the resonant frequency $\omega_s$ assumes a value other than the frequency $\omega$ (for example, a frequency value contained in a frequency band between a pair of adjacent frequency values selected from a series of sequential frequency values). The resonant frequency $\omega_s$ of the strip 7*a* of the aperture grille 7 can be achieved by changing the tension in the strip 7*a*. Alternatively, the integer n may be chosen to satisfy $1 \leqq n \leqq 6$, and the integer N may be chosen to satisfy $1 \leqq N \leqq 6$. In certain instances, the integer n may be chosen to satisfy $1 \leqq n \leqq 5$, and the integer N may be chosen to satisfy $1 \leqq N \leqq 5$. It will be appreciated that when a broader range is chosen for the integers n and N; the effect of alleviating a degradation in image quality will increase, but this imposes a more stringent requirement upon the aperture grille 7 to increase the difficulty of manufacture. Accordingly, the range for the integers n and N may be determined on the basis of factors including the type of the color picture tube, the environment in which it is installed, the performance required of the color picture tube, and the like.

(Explanation For The Series Of Sequential Frequency Values)

The series of sequential frequency values X will now be considered. When the integers n and N are positive integers ($1 \leqq n \leqq 7$, $1 \leqq N \leqq 7$), the ratio n/N will be as indicated in Table

TABLE 1

| | N | | | | | | |
|---|---|---|---|---|---|---|---|
| n | 1 | 2 | 3 | 4 | 5 | 6 | 7 |
| 1 | 1/1 | 1/2 | 1/3 | 1/4 | 1/5 | 1/6 | 1/7 |
| 2 | 2/1 | 2/2 | 2/3 | 2/4 | 2/5 | 2/6 | 2/7 |
| 3 | 3/1 | 3/2 | 3/3 | 3/4 | 3/5 | 3/6 | 3/7 |
| 4 | 4/1 | 4/2 | 4/3 | 4/4 | 4/5 | 4/6 | 4/7 |
| 5 | 5/1 | 5/2 | 5/3 | 5/4 | 5/5 | 5/6 | 5/7 |
| 6 | 6/1 | 6/2 | 6/3 | 6/4 | 6/5 | 6/6 | 6/7 |
| 7 | 7/1 | 7/2 | 7/3 | 7/4 | 7/5 | 7/6 | 7/7 |

When the vertical scan frequency $\omega_v$ the color picture tube is chosen to be equal to 60 Hz, the frequency $\omega$ ($=\omega_v * n/N$) assume values $\omega$ as indicated in Table 2 below.

TABLE 2

| | N | | | | | | |
|---|---|---|---|---|---|---|---|
| n | 1 | 2 | 3 | 4 | 5 | 6 | 7 |
| 1 | 60 | 30 | 20 | 15 | 12 | 10 | 9 |
| 2 | 120 | 60 | 40 | 30 | 24 | 20 | 17 |
| 3 | 180 | 90 | 60 | 45 | 36 | 30 | 26 |
| 4 | 240 | 120 | 80 | 60 | 48 | 40 | 34 |
| 5 | 300 | 150 | 100 | 75 | 60 | 50 | 43 |
| 6 | 360 | 180 | 120 | 90 | 72 | 60 | 51 |
| 7 | 420 | 210 | 140 | 105 | 84 | 70 | 60 |

It will be seen from Table 2 that the series of sequential frequency values $\omega$ (in unit of Hz) when the vertical scan frequency $\omega_v$ is chosen to be 60 Hz are as follows: 9, 10, 12, 15, 17, 20, 26, 30, 34, 40, 43, 51, 60, 70, 84, 90, 105, 120, 140, 180, 210, 240, 300, 360, and 420.

Figure 3:
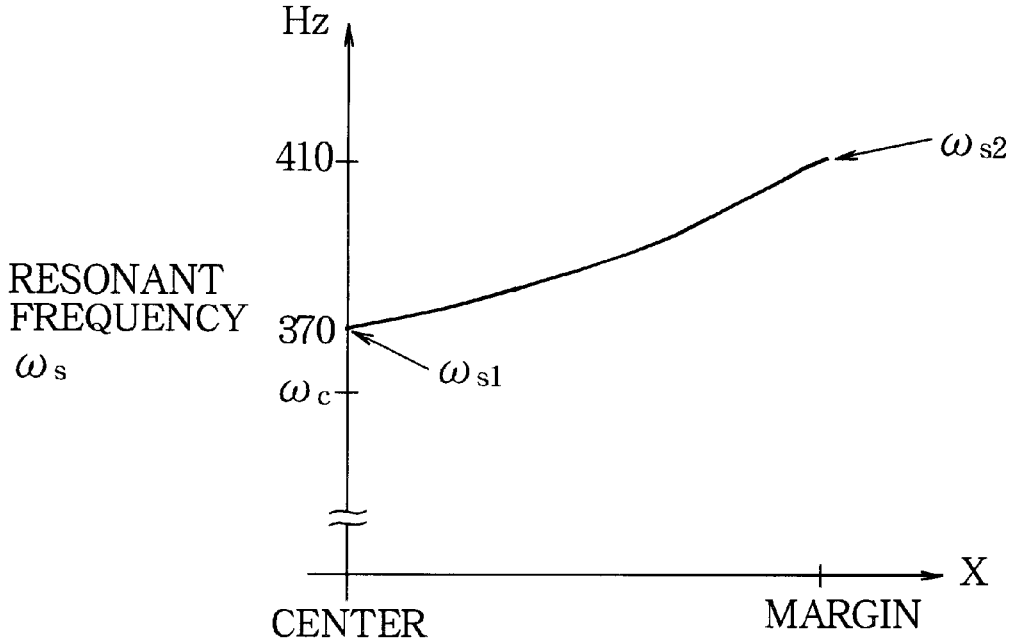
FIG. 3 graphically shows a change in the resonant frequency of the aperture grille of the first embodiment in accordance with a horizontal position on the aperture grille.

As mentioned previously, in the color picture tube of the first embodiment, an arrangement is made such that the resonant frequency $\omega_s$ the aperture grille 7 assumes a value other than the frequency $\omega$, for example, a frequency value in a frequency band defined by a pair of adjacent frequency values in the series. FIG. 3 graphically shows an exemplary distribution of the resonant frequencies $\omega_s$ for the aperture grille 7. In this example, a resonant frequency $\omega_{s1}$ around a center of the aperture grille 7 in the horizontal direction is chosen to be about 370 Hz, a resonant frequency $\omega_{s2}$ near a margin (i.e., near an end portion) of the aperture grille 7 in the horizontal direction is chosen to be about 410 Hz, thus providing a difference of about 40 Hz between the both resonant frequencies $\omega_{s1}$ and $\omega_{s2}$ It will be noted that the example shown in FIG. 3 represents a distribution of resonant frequencies which are contained between a pair of adjacent frequency values $\omega$ of 360 Hz and 420 Hz in the series of sequential frequency values.

When the positive integers n and N are chosen such that $1 \leqq n \leqq 6$ and $1 \leqq N \leqq 6$ and a vertical scan frequency $\omega_v$ is chosen to be equal to 60 Hz, the series of sequential frequency values $\omega$ (in unit of Hz) will be as follows: 10, 12, 15, 17, 20, 30, 40, 60, 90, 120, 180, 240, 300, and 360.

(Reason For Setting The Resonant Frequency To Be Other Than The Frequency Values In The Series).

The reason that the resonant frequency $\omega_s$ of the aperture grille 7 is chosen to be other than frequency values $\omega$ in the series of the sequential frequency values thereof in the color picture tube of the first embodiment will now be described. It is to be understood that the aperture grille 7, in actuality, has a resonant frequency $\omega_s$ which depends on the horizontal position on the aperture grille 7, but to simplify the description, a resonance of a specific narrow region of the aperture grille 7 will be considered here.

An instance will be initially considered in which the resonant frequency $\omega_s$ of the aperture grille 7 is 60 Hz as indicated in Table 2 (for n/N=1/1, for example). In this instance, the aperture grille 7 will oscillate with a period of 60 Hz, but because the raster is depicted with a vertical scan having the vertical scan frequency of 60 Hz, and accordingly the oscillation of the aperture grille 7 is completely synchronized with the vertical scan frequency $\omega_v$. Accordingly, it would appear that the shadow of the aperture grille 7 as projected by the electron beam is not in motion. Hence, if the resonance frequency $\omega_s$ of the aperture grille 7 is chosen to be completely coincident with 60 Hz, the image will be formed in completely the same way as when there is no resonance in the aperture grille 7. However, in actuality, it is impossible to achieve a resonant frequency $\omega_s$ of the aperture grille 7 which remains constant in a stable manner over the entire region of the aperture grille 7 for the color picture tube.

The choice of a resonant frequency $\omega_s$ of the aperture grille 7 equal to 30 Hz shown in Table. 2 (for n/N equal to ½, for example) will now be considered. In this instance, the aperture grille 7 will oscillate with a period of 30 Hz, but because the raster is depicted with a vertical scan having a vertical scan frequency of 60 Hz, a pair of images are formed during one period of oscillation. If one of the images is formed at a normal position, the other image will be formed at a position which is offset from the normal position by an amount corresponding to the maximum amplitude of oscillation of the aperture grille 7. When the aperture grille 7 is in resonance, the position of the opening 7*b* in the aperture grille 7 will be displaced in accordance with the oscillation, and accordingly the electron beam 5 cannot properly irradiate an intended phosphor or irradiate an adjacent phosphor of different color. In such instance, the color unevenness or the color shift will occur in the image being displayed.

Another instance in which the resonant frequency $\omega_s$ of the aperture grille 7 is chosen to be 50 Hz (for n/N equal to ⅚, for example) as indicated in Table 2 will now be considered. In this instance, the aperture grille 7 will oscillate with a period of 50 Hz, but because the raster is depicted with a vertical scan having the vertical scan frequency of 60 Hz, an identical phenomenon will be repeated every sixth image. A degradation in image quality which is caused by the resonance of the aperture grille 7 will be similar for the instance of n/N equal to ½, but the degree of light diminution per image, which is caused by the resonance of the aperture grille 7, will be reduced as compared with the instance of n/N equal to ½.

The influence upon the image quality has been theoretically considered for the resonant frequency $\omega_s$ of the aperture grille 7 which is equal to 60 Hz, 30 Hz, and 50 Hz, respectively. However, in actuality, it is difficult to maintain a constant value for the resonant frequency $\omega_s$ of the aperture grille 7 over the entire region thereof in a stable manner. Where the distribution of the resonant frequencies $\omega_s$ of the aperture grille 7 extends across a range including the series of frequency values $\omega$ indicated in Table 2, a degradation in image quality will be more pronounced over the entire screen. This is because there is a significant, difference in the influence upon image quality caused by the oscillation of strips between when the resonant frequency $\omega_s$ of the aperture grille coincides with one of the values indicated in Table 2 and when it is not coincident with such value, and because such difference is distributed across the entire screen to emphasize a degradation in image quality. Accordingly, in the color picture tube of the first embodiment, the resonant frequency $\omega_s$ of the aperture grille 7 is distributed among frequency bands, each of which is defined by a pair of adjacent frequency values in the series.

(Reason For Upper Limit Of The Integers N And N)

The reason why the values of the integers n and N which are equal to or less than seven are taken into consideration will be described. Representing a mass of an object which is subject to an oscillation by m, a force acting upon the object by F, an amplitude of oscillation of the object by x, a frequency by f ($=\Omega/2\pi$), an angular frequency by $\Omega$ ($=2\pi f$), and a time by t, we have $$F=md^2x/dt^2=-m\ \Omega^2x$$

it then follows:

$$F\ \Omega^2x\ f^2x$$

Assuming that the force F remains constant, $f^2x$ also remains constant and hence the displacement x at a particular frequency will be proportional to $1/f^2$. It is then seen that when the strips 7*a* of the aperture grille 7 oscillate at a high frequency, the amplitude of oscillation (or displacement x) of the strips will be minimal (being inversely proportional to the square of the frequency), thus minimizing the influence upon the image quality. In this manner, when the resonant frequency $\omega_s$ of the strip is as high as exceeding 420 Hz, the influence upon the image quality is greatly reduced, allowing a judgment that there is no need to consider values of the integers n and N which exceed 7. Nevertheless, it is unnecessary to limit the extent for the integers n and N as being equal to or less than 7, but the upper limit of the integers n and N may be equal to or more than 8 or equal to or less than 6.

(Reason Why The Oscillation Of Resonant Frequency Is Noticeable For A Viewer)

What has been considered above is summarized in Table 3 shown below. However, it is to be noted that for purpose of simplicity of description, it is assumed in Table 3 that the integers n and N are equal to or less than six, even though these integers have been assumed as being equal to or less than seven in the above description.

TABLE 3

| $\omega = \omega_v$*n/N | 10 | 12 | 15 | 20 | 24 | 30 | 36 | 40 |
|---|---|---|---|---|---|---|---|---|
| n/N | 1/6 | 1/5 | 1/4 | 1/3 | 2/5 | 1/2 | 3/5 | 2/3 |
| n*N | 6 | 5 | 4 | 3 | 10 | 2 | 15 | 6 |
| C = 1/n*N | 0.17 | 0.20 | 0.25 | 0.33 | 0.10 | 0.50 | 0.07 | 0.17 |
| k = $(\omega_v/\omega)^2$ | 36 | 25 | 16 | 9 | 6.3 | 4 | 2.8 | 2.3 |
| C*k | 6.1 | 5.0 | 4.0 | 3.0 | 0.6 | 2.0 | 0.2 | 0.4 |
| $\omega = \omega_v$*n/N | 45 | 48 | 50 | 60 | 72 | 75 | 80 | 90 |
| n/N | 3/4 | 4/5 | 5/6 | 1/1 | 6/5 | 5/4 | 4/3 | 3/2 |
| n*N | 12 | 20 | 30 | 1 | 30 | 20 | 12 | 6 |
| C = 1/n*N | 0.08 | 0.05 | 0.03 | 1.0 | 0.7 | 0.6 | 0.6 | 0.4 |
| k = $(\omega_v/\omega)^2$ | 1.8 | 1.6 | 1.4 | 1.0 | 0.7 | 0.6 | 0.6 | 0.4 |
| C*k | 0.1 | 0.1 | 0 | 1.0 | 0 | 0 | 0 | 0.1 |
| $\omega = \omega_v$*n/N | 100 | 120 | 150 | 180 | 240 | 300 | 360 | |
| n/N | 5/3 | 2/1 | 5/2 | 3/1 | 4/1 | 5/1 | 6/1 | |
| n*N | 15 | 2 | 10 | 3 | 4 | 5 | 6 | |
| C = 1/n*N | 0.07 | 0.50 | 0.10 | 0.33 | 0.25 | 0.20 | 0.17 | |
| k = $(\omega_v/\omega)^2$ | 0.4 | 0.3 | 0.2 | 0.1 | 0.1 | 0 | 0 | |
| C*k | 0 | 0.2 | 0 | 0 | 0 | 0 | 0 | |

In Table 3, C (=1/n*N) represents an index indicating the noticeability (contrast) of a change on the screen, k represents an index indicating a wobble liability per frequency when an oscillation energy supplied from the exterior and its amplitude are maintained constant, and C*k represents an index indicating the noticeability of a change on the screen per frequency when a resonance occurs in the aperture grille 7 during a usual raster scan.

Next, n*N, an index used for the contrast, and C (=1/n*N) and index indicating the contrast, will now be described. As mentioned previously, when an instance in which the ratio n/N associated with the vertical scan frequency $\omega_v$ of the color picture tube is equal to ½ and another instance in which it is equal to ⅚ are compared, a degradation in image quality which is caused by the resonance is less noticeable when the ratio n/N is equal to ⅚. It is seen therefore that the less n*N, the higher the contrast of the image, causing a degradation in image quality which is attributable to the resonance to be more noticeable. Accordingly, C (=1/n*N) can be used as one index indicating the contrast, and it then follows that the smaller the value of C, the less a degradation in image quality which is attributable to the resonance is noticeable.

Figure 4:
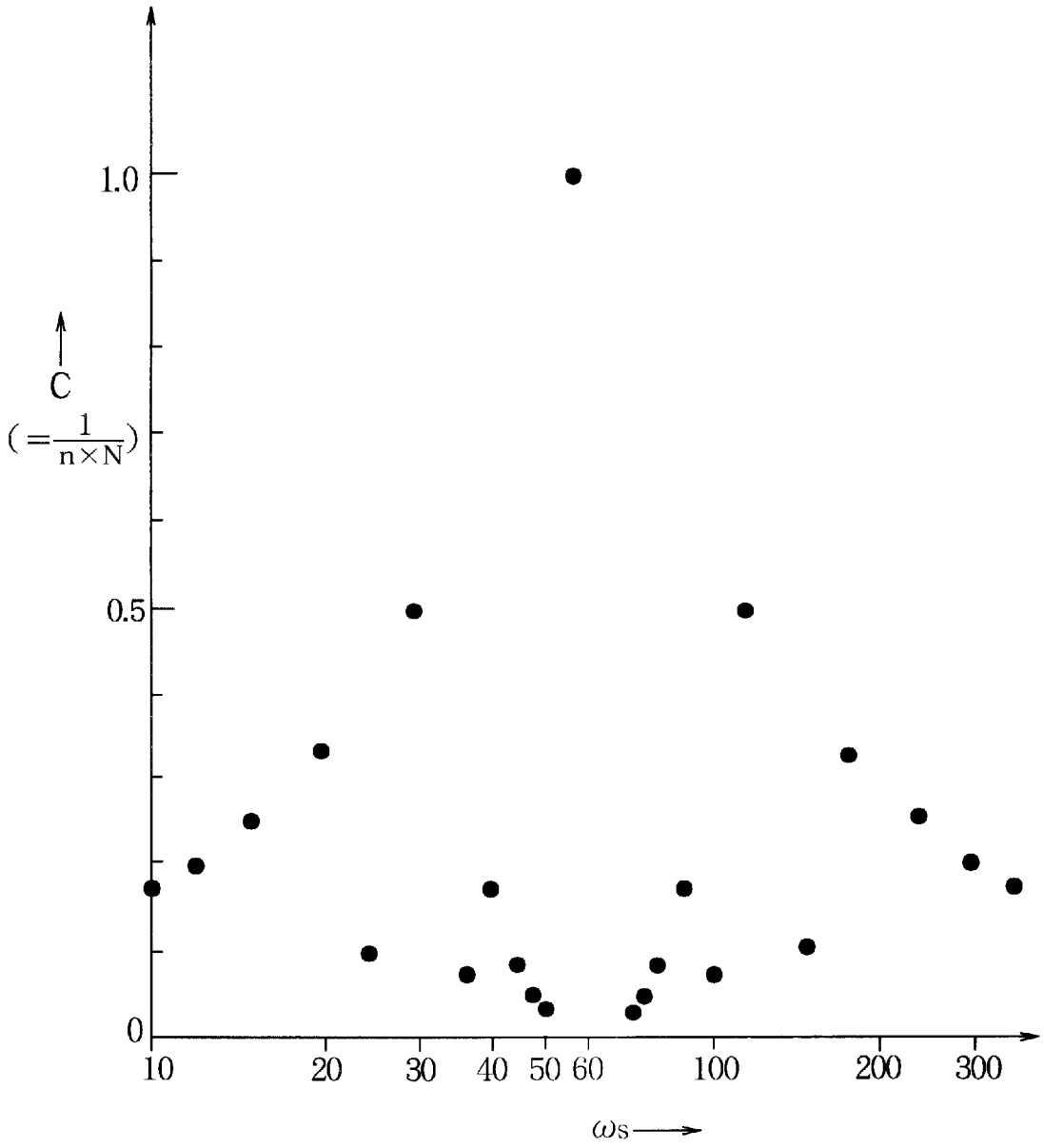
FIG. 4 graphically plots a relationship between the resonant frequency of the aperture grille of the first embodiment and an index C representing a contrast.

FIG. 4 graphically shows a relationship between the contrast C and the resonant frequency $\omega_s$. It is to be noted that a logarithmic scale is used for the abscissa in FIG. 4. It will be seen from FIG. 4 that when the vertical scan frequency $\omega_v$ is equal to 60 Hz, it is desirable that the aperture grille 7 has no resonance at 10, 12, 15, 20, 30, 40, 60, 90, 120, 180, 240, 300, and 360 Hz.

(Reason For Setting The Resonance Frequency At A High Value)

Figure 5:
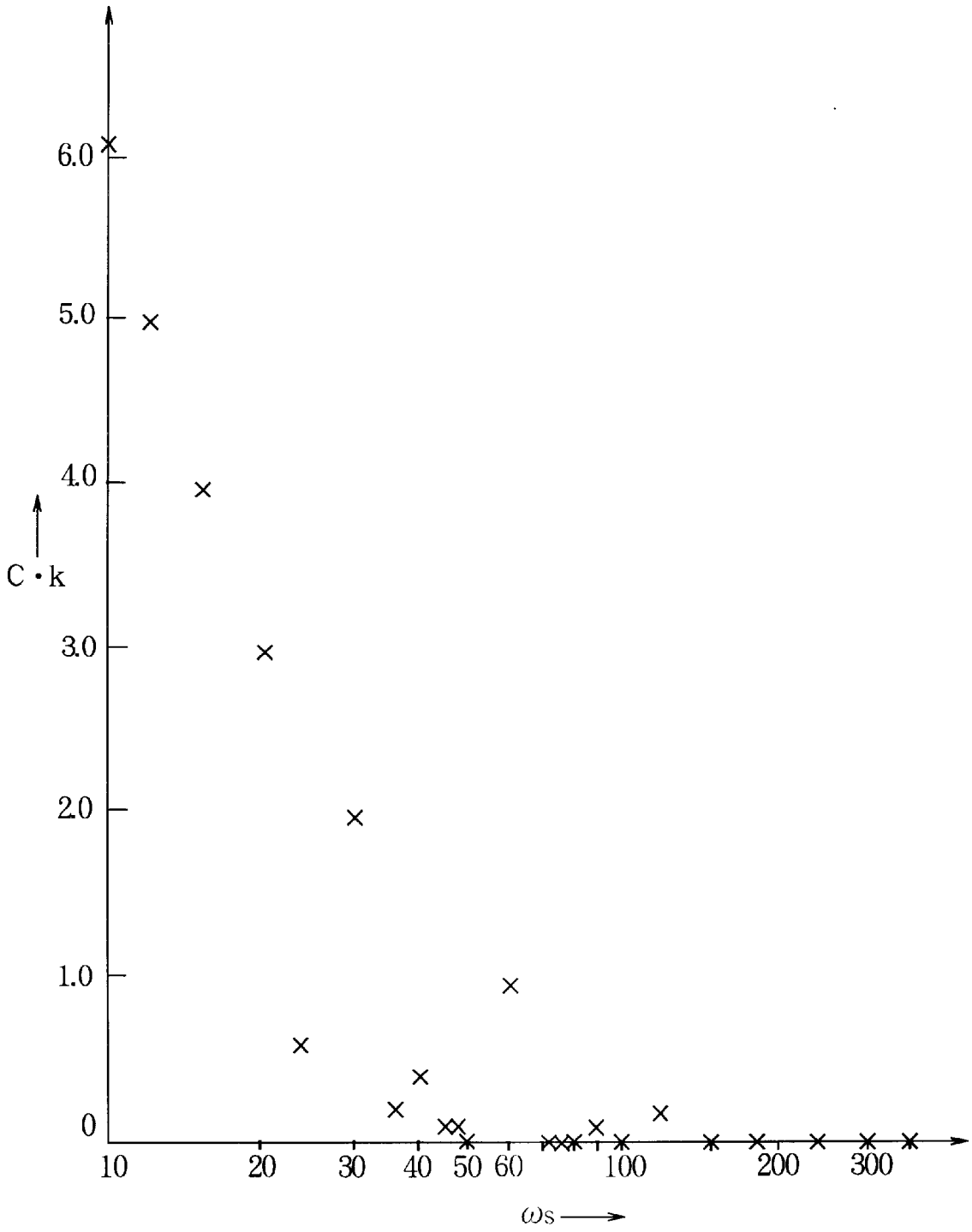
FIG. 5 graphically shows a relationship between an index C*k and the resonant frequency of the aperture grille of the first embodiment.

FIG. 5 graphically shows a relationship between the index C*k and the resonant frequency $\omega_s$. The index k indicating the wobble liability per frequency when the oscillation energy supplied from the exterior and its amplitude are maintained constant and the index C*k indicating the noticeability of a change on the screen per frequency when a resonance occurs in the aperture grille during a usual raster scan, both appearing in Table 3, will now be considered with reference to FIG. 5. As has been mentioned above, for the relationship between the frequency f and the displacement x when the oscillation energy is constant, we have $$\omega_s^2 * \Delta = \text{constant}$$

or $$\Delta(\text{displacement})\ 1/\omega_s^2$$

Accordingly, $k=(\omega_v/\omega_s)^2$ will be an index indicating the wobble liability in general frequency representation. For example, when $\omega_v$=60 Hz and $\omega_s$=30 Hz, we have k=4.

It will be noted from FIG. 5 that the index C*k may assume a value above 1 when the resonant frequency $\omega_s$ is equal to or less than 60 Hz. Accordingly, unless there is no singular tendency in the natural oscillation behavior of the aperture grille, it is necessary to reduce the width of oscillation or wobble due to the resonant frequency $\omega_s$ in a region of frequency 60 Hz when the deflection frequency $\omega_v$ equal to 60 Hz. This is because when the index C*k increases above 1, the contrast becomes high, causing the color shift caused by the resonance to be more noticeable. It is also desirable to shift the resonance point of the aperture grille 7 from low resonant frequencies such as 20, 15, 12, and 10 Hz. It is to be notable that a logarithmic scale is also used for the abscissa in FIG. 5.

In addition, as shown in FIG. 4, if the vertical scan frequency is 60 Hz and the resonant frequency $\omega_s$ lies at one of the frequencies 360, 300, 240, 180, 120, 90, 60, 40, 30, 20, 15, 12, and 10, the contrast increases, which is disadvantage for image quality. Accordingly, these frequencies are referred to as high contrast resonant frequencies, and will be denoted by $\omega_c$.

(Advantage Of The Color Picture Tube)

It will be understood from the foregoing that a degradation in image quality which is attributable to oscillations of the aperture grille 7 can be made less noticeable by choosing the resonant frequency $\omega_s$ of the aperture grille 7 to be offset from the frequency $\omega$. More specifically, when the resonant frequency $\omega_s$ of the aperture grille 7 is chosen to be in a frequency band defined between a pair of adjacent frequency values in the series of sequential frequency values $\omega$, such as in a band higher than 300 Hz and lower than 360 Hz, a degradation in image quality by any resonance of the aperture grille 7 can be made less noticeable.

It is possible to provide a desired distribution for the tension in the strips 7*a* of the aperture grille 7 over the entire area of the fluorescent screen 3 by adjusting the tension of the respective strips 71, as disclosed in Japanese Patent Kokai Publication No. 62-253031 and No. 61-240531. A prior art aperture grille generally has a resonant frequency of 200 Hz near its center, and a resonant frequency of 320 Hz near its margin, providing a difference therebetween which is as large as 120 Hz. In this instance, two of high contrast frequencies $\omega_c$ will be contained within the frequency band for the distribution of resonant frequencies, meaning that a resonance may occur at two distinct frequencies. To accommodate for this, the breadth of resonant frequencies contained in a region from the center to the margin of the aperture grille is limited to within 40 Hz, from which any high contrast resonant frequency $\omega_s$ is excluded.

In the color picture tube according to the first embodiment, the thickness, the width, the tension, and the material of the strips 7*a* of the aperture grille 7 are chosen so that the resonant frequency $\omega_s$ of the strips 7 of the aperture grille 7 runs above 350 Hz. Since the amplitude which is inversely proportional to the square of the resonant frequency $\omega_s$ is reduced as the resonant frequency $\omega_s$ is increased, the amplitude can be reduced to a range, which may be from 5 $\mu$m to 10 $\mu$m, for example, which cannot be perceived by a viewer. With this arrangement, a degradation in image quality which is attributable to the resonance of the aperture grille 7 can be made less noticeable without the provision of damper wires and damper springs which has been used in a prior art color picture tube.

Second Embodiment

A color picture tube according to a second embodiment of the present invention represents an example of adopting the above-mentioned approaches (3) and (1).

(Explanation For Arrangement And Operation)

Figure 6:
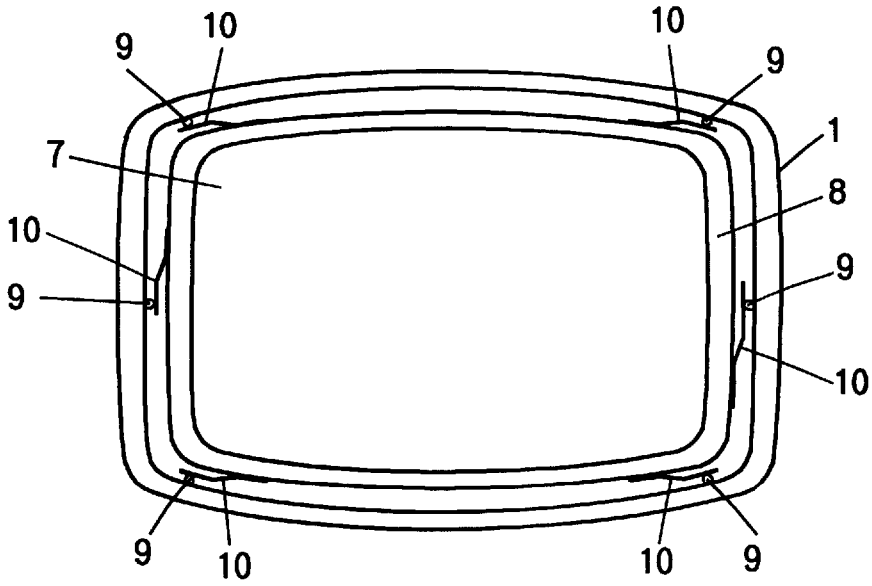
FIG. 6 is a view showing the layout of pins and leaf springs of a color picture tube according to a second embodiment of the present invention.
Figure 7:
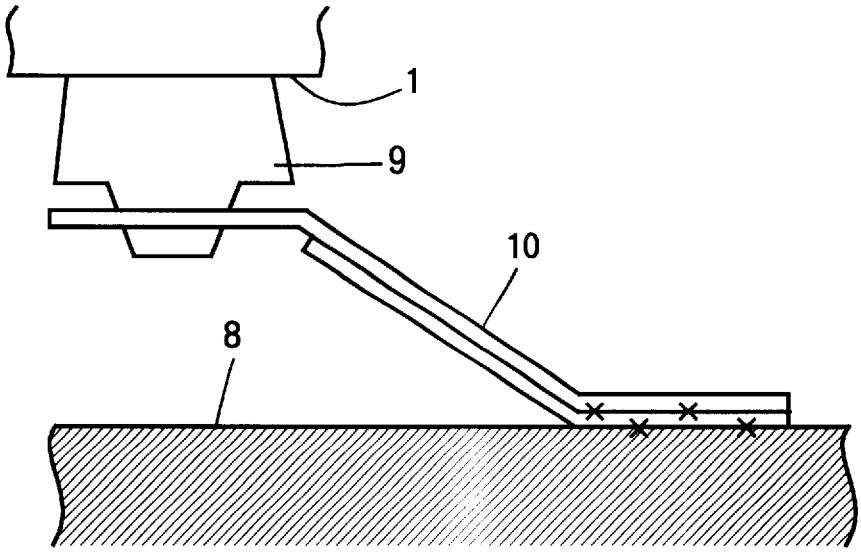
FIG. 7 is an enlarged view showing a leaf spring of the color picture spring of the second embodiment.
Figure 8:
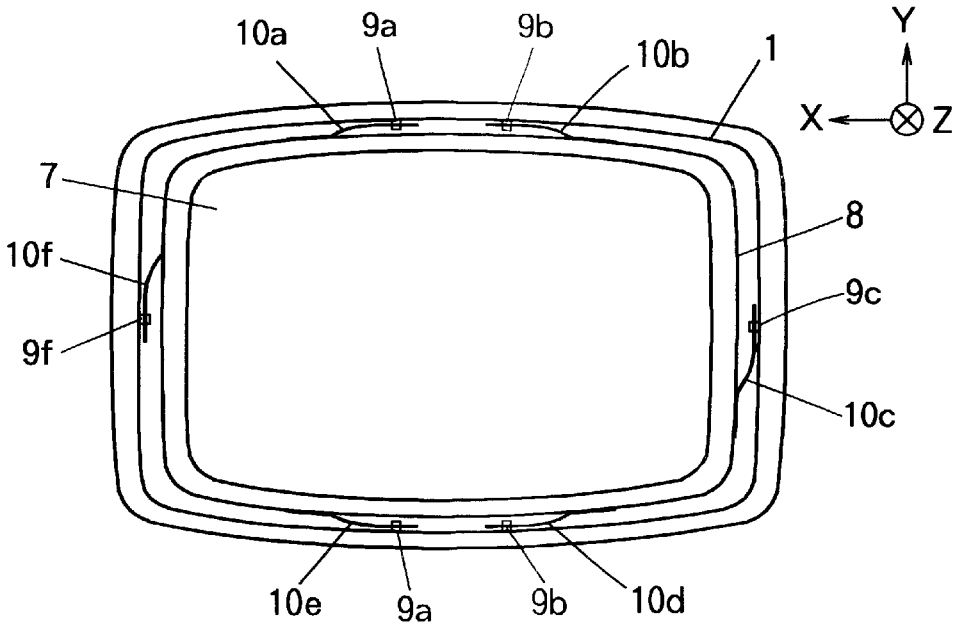
FIG. 8 is a view showing another layout of pins and leaf springs of the color picture tube of the second embodiment.

FIG. 6 is a view showing the layout of pins and leaf springs used with a face panel of a color picture tube according to the second embodiment of the present invention, FIG. 7 is an enlarged view of a leaf spring and a pin, and FIG. 8 is a view showing another exemplary layout of pins and leaf springs associated with the color picture tube according to the second embodiment.

Figure 9:
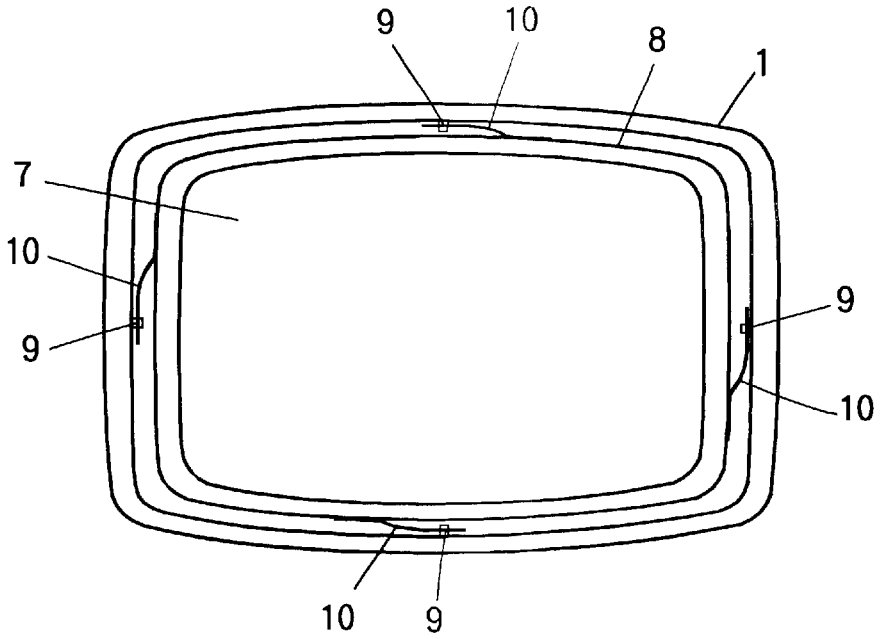
FIG. 9 PRIOR ART
FIG. 9 is a view showing the layout of pins and leaf springs in a prior art color picture tube.

A prior art color picture tube is illustrated in FIG. 9 where four pins 9 secured to the internal surface of a face panel 1 and four leaf springs 10 for carrying a frame 8 are provided. By contrast, in the color picture tube according to the second embodiment which is illustrated in FIG. 6 or FIG. 8 includes six pins 9 provided on the internal surface of the face panel 1 and six leaf springs 10 for carrying the frame 8. In the example shown in FIG. 6, two leaf springs 10 support a horizontal member (corresponding to those shown as 8*a* and 8*b* in FIG. 2B) of the frame 8 adjacent to the opposite ends thereof or in a region around the corners of the face panel 1. In the example shown in FIG. 8, two leaf springs 10 support a horizontal member of the frame 8 around its center. As illustrated in FIG. 7, the leaf spring 10 has its one end engaged with a pin 9 while its other end is secured to the frame 8. While the leaf spring 10 shown in FIG. 7 comprises a pair of leaf members joined together by lap welding, it need not be limited to such arrangement, but may comprise a single leaf member.

In the color picture tube of the second embodiment, the horizontal member of the frame 8 which supports the aperture grille 7 is supported by the pair of leaf springs 10, and thus the frame 8 is more rigidly secured to the face panel 1 than in the prior art arrangement as shown in FIG. 9. Accordingly, the resonant frequency $\omega_s$ of the aperture grille 7 which is supported by the frame 8 can be made higher than the resonant frequency of the aperture grille 7 of the prior art color picture tube.

Figure 10:
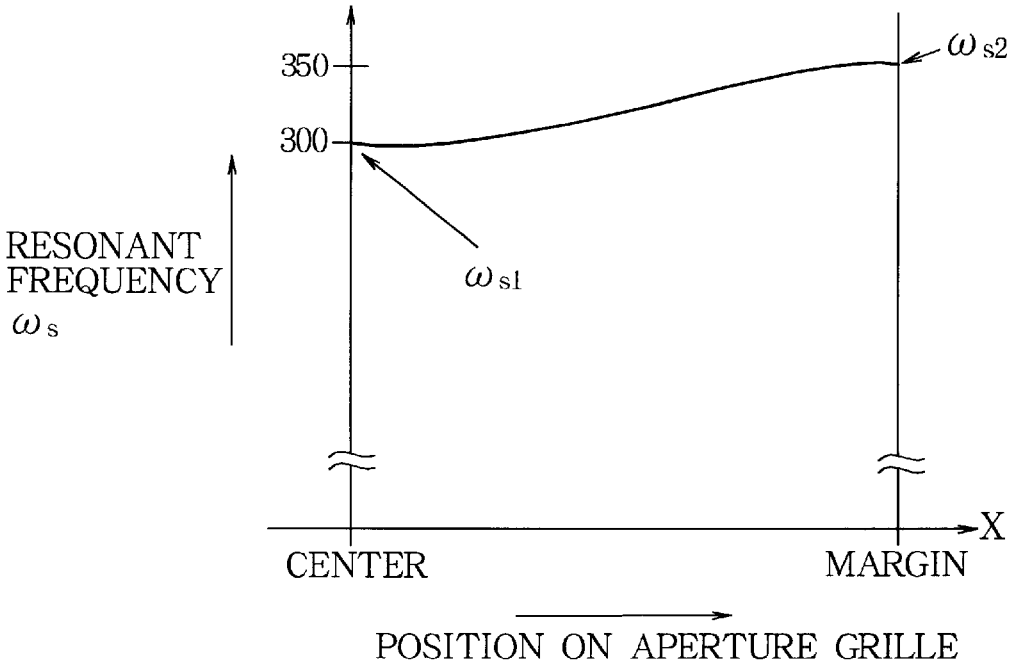
FIG. 10 graphically shows a distribution of resonant frequencies for the aperture grille of the second embodiment.
Figure 11:
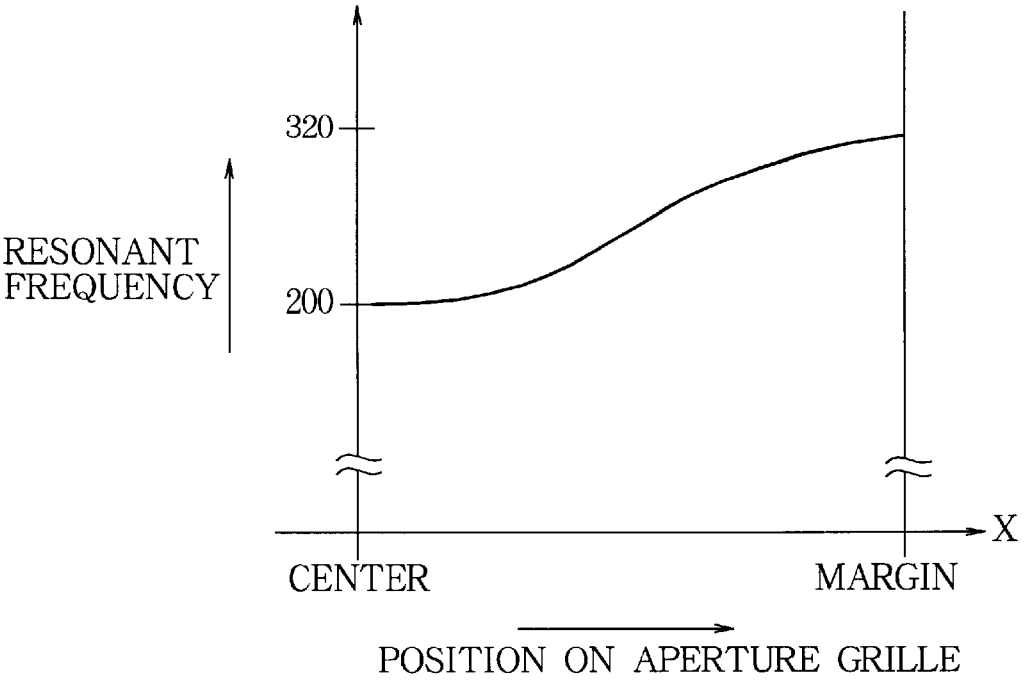
FIG. 11 PRIOR ART
FIG. 11 graphically shows a distribution of resonant frequencies for the prior art aperture grille.

FIG. 10 graphically shows a distribution of resonant frequencies of the aperture grille 7 of the second embodiment shown in FIG. 8, while FIG. 11 graphically shows a distribution of resonant frequencies of the prior art aperture grille as shown in FIG. 9. As shown in FIG. 10, in the color picture tube of the second embodiment, one of the strips 7*a* which is located at the central position in the X direction of the aperture grille 7 has a resonant frequency $\omega_{s1}$ of about 300 Hz, and one of the strips 7*a* which is located at either end of the aperture grille 7 in the X direction of the aperture grille 7 has a resonant frequency $\omega_{s2}$ of about 350 Hz. In this manner, the resonant frequency $\omega_s$ varies depending on the position on the aperture grille 7 in the second embodiment, with a difference $\Delta\omega_s$ of about 50 Hz. In contrast, as shown in FIG. 11, in the prior art color picture tube, one of the strips 7*a* located at the central position in the left-and-right direction (X direction) of the aperture grille 7 has a resonant frequency of about 200 Hz and one of the strips 7*a* located at either end in the left-and-right direction (X direction) of the aperture grille 7 has a resonant frequency of about 320 Hz, thus exhibiting a distribution of resonant frequencies depending on the position on the aperture grille 7 and having a difference of about 120 Hz between a maximum and a minimum value.

Comparing the distributions of the resonant frequencies as shown in FIG. 10 and FIG. 11, it will be noted that the oscillation behavior of the aperture grille 7 of the second embodiment shown in FIG. 10 has a resonant frequency which is generally higher than that of the prior art aperture grille shown in FIG. 11, the resonant frequency at the end of the aperture grille of the second embodiment is only order of 30 Hz higher than the resonant frequency at the end of the prior art aperture grille. Comparing the resonant frequencies at or near the center of the aperture grilles, the resonant frequency at the center of the aperture grille 7 of the second embodiment is only order of 100 Hz higher than the resonant frequency at or near the center of the prior art aperture grille. As a consequence, when comparing the differences $\Delta\omega_s$ in the resonant frequencies, the difference $\Delta\omega_s$ for the aperture grille 7 of the second embodiment is 50 Hz, which is narrower than 120 Hz in the prior art aperture grille, and is below the vertical scan frequency $\omega_v$ (=60 Hz)

(Reason For Setting The Resonance Frequency At The End Of The Aperture Grill To Higher Value Than That At The Center Thereof)

Figure 12:
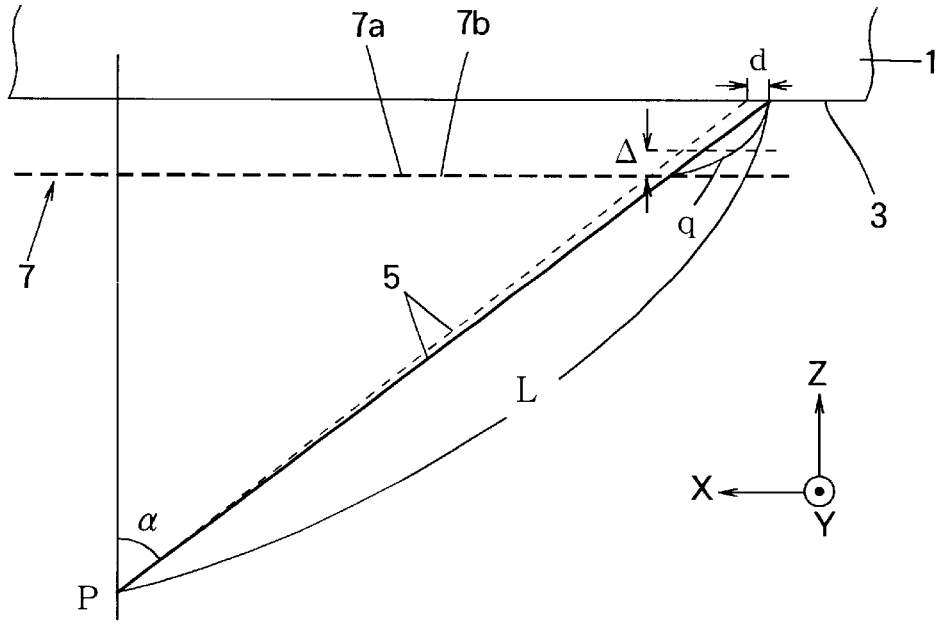
FIG. 12 is an illustration showing how a position on a fluorescent screen which is irradiated by an electron beam is displaced when the aperture grille is subject to oscillation.

A landing error which is caused by the resonance of the aperture grille 7 will be next described. FIG. 12 is a graphical illustration of a displacement of the position on the fluorescent screen which is irradiated by the electron beam that is caused by an oscillation of the aperture grille. In FIG. 12, it is assumed that the electron beam 5 is defected from the center of deflection of the deflection yolk at a deflection angle $\alpha$, and a distance to the fluorescent screen 3 is denoted by L, a distance traveled by the electron beam from the aperture grille 7 to the internal surface of the face panel by q, and a displacement in the tube axis (Z direction) of the aperture grille which is caused by the oscillation by $\Delta$. Then a landing error (or displacement) d of the electron beam on the fluorescent screen 3 is given by the following equation:

$$d=\Delta\tan\alpha*L/(1-q)$$

It is assumed here that the wobble of the aperture grille 7 upon the resonance occurs only in the Z direction, but it should be understood that in actuality, the wobble also occurs in directions orthogonal to the Z direction. However, because the aperture grille 7 comprises strips in the form of tapes, the wobble in the other directions can be neglected in comparison to the wobble occurring in the Z direction.

Assuming that the constant d remains constant, it follows that the displacement A in the tube axis direction (Z direction) of the aperture grille 7 upon resonance is related to tan $\Delta$ as follows:

$$\Delta\ 1/\tan\alpha$$

Figure 13:
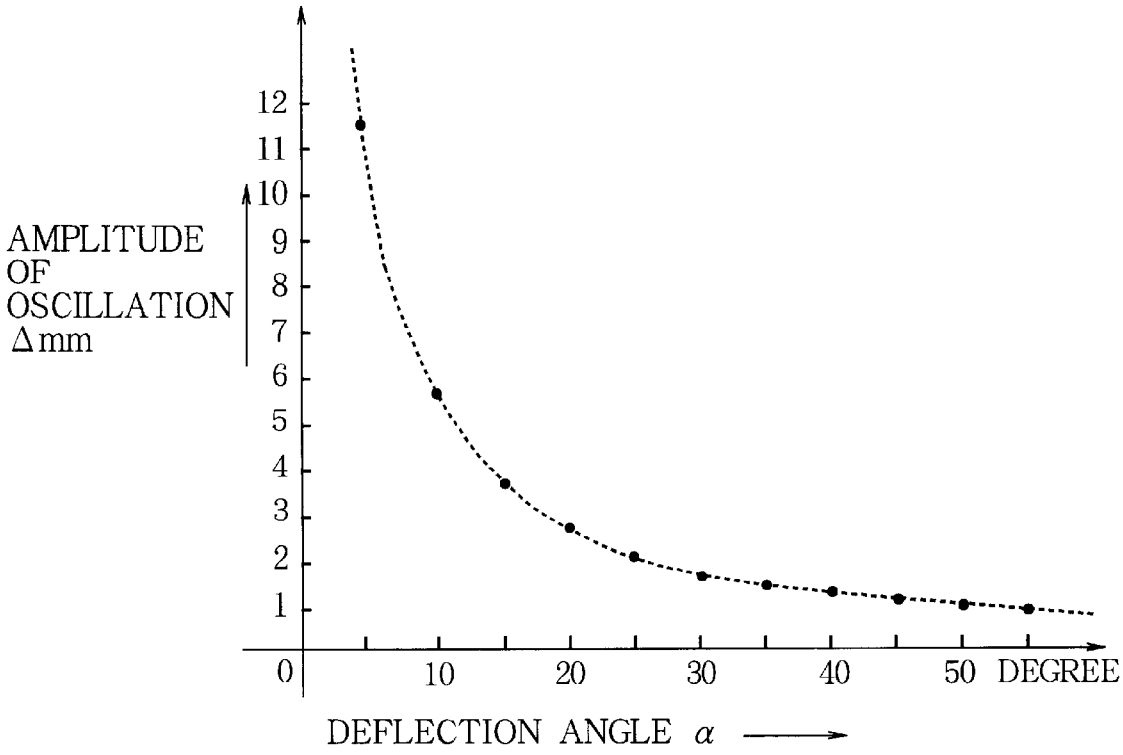
FIG. 13 graphically shows a permissible displacement for the aperture grille as plotted against the horizontal deflection angle of the electron beam.

FIG. 13 graphically shows a displacement which is permissible to an aperture grille, plotted against a horizontal deflection angle of the electron beam. In FIG. 13, the ordinate represents the amplitude $\Delta$ (in mm) of the wobble while the abscissa represents the deflection angle $\alpha$ (in degrees). It will be noted that FIG. 13 indicates that a margin against the oscillation near the center of the fluorescent screen ($\alpha$=0) is greater than that near the end of the fluorescent screen.

As discussed above, in the second embodiment, both the pins 9 and the leaf springs 10 which support the frame 8 which in turn supports the aperture grille 7 are six in number, thereby increasing the resonant frequency of the aperture grille 7. In this manner, the amplitude of oscillation of the aperture grille 7 can be reduced well within the permissible amplitude $\Delta$ shown in FIG. 13. In addition, when the resonant frequency at the end portion of the aperture grille 7 is increased, the amplitude of oscillation at the end portion where the permissible amplitude Δ is reduced can be reduced, thus providing a structure in which a degradation in image quality which is attributable to oscillations is less noticeable.

In the second embodiment, it has been described that six pins 9 and leaf springs 10 are provided, but it should be understood that the number of the pins 9 and the leaf springs 10 may be equal to 7 or greater. In another respects, the arrangement of the second embodiment is identical with the arrangement of the first embodiment initially mentioned.

Third Embodiment

A color picture tube of a third embodiment represents an example of adopting the approaches (3) and (1). The third embodiment differs from the second embodiment in the disposition of pins and leaf springs in the color picture tube and the construction of the leaf springs.

Figure 14A:
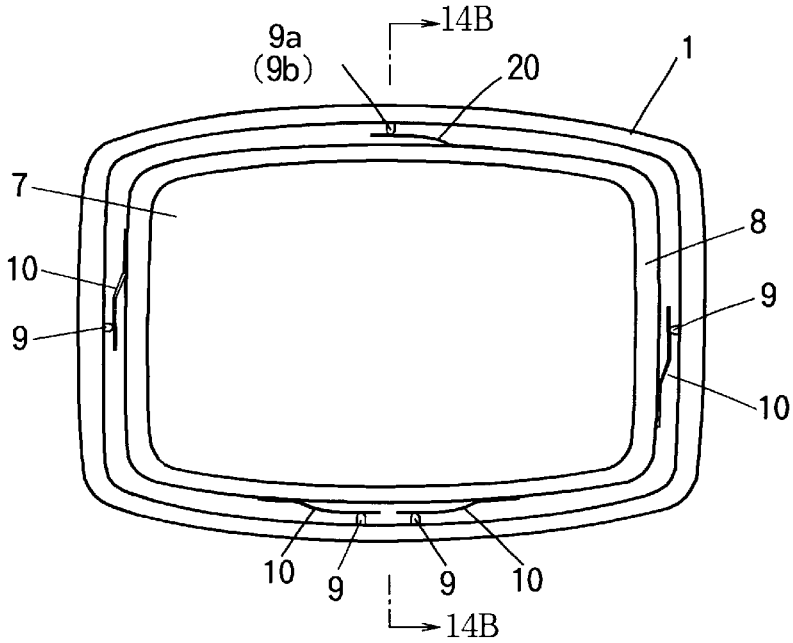
FIG. 14A is a view showing the layout of pins and leaf springs of a color picture tube according to a third embodiment of the present invention.
Figure 14B:
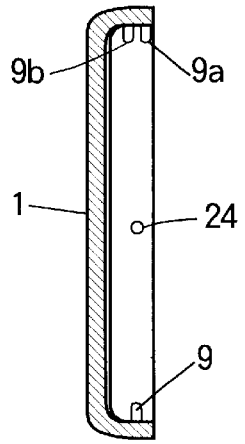
FIG. 14B is a cross section taken along the line 14B—14B shown in FIG. 14A.
Figure 14C:
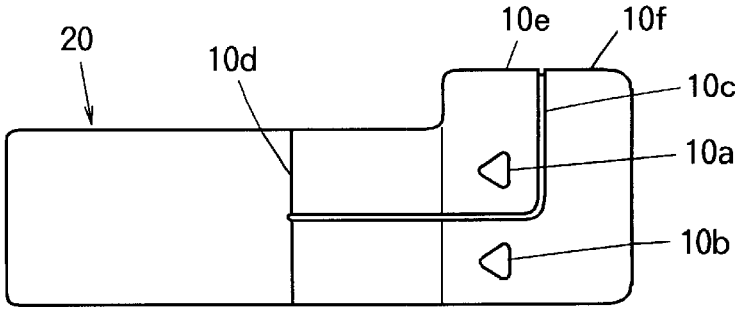
FIG. 14C is a plan view showing the leaf springs shown in FIG. 14A to an enlarged scale.

FIG. 14A is a view showing the layout of pins and leaf springs of a color picture tube according to the third embodiment of the present invention, FIG. 14B is a cross section taken along the line 14B shown in FIG. 14A, and FIG. 14C is a plan view showing a leaf spring of FIG. 14A to an enlarged scale. In FIGS. 14A to 14C, parts corresponding to those shown in FIG. 6, FIG. 7, and FIG. 8 are designated by the same reference characters as before. As mentioned previously, the aperture grille 7 is supported by the face panel 1 by using six leaf springs in the color picture tube of the first embodiment in order to increase the resonant frequency $\omega_s$ in a manner as illustrated in FIG. 10. However, a degradation in image quality which is attributable to oscillations can also be alleviated by reducing the amplitude of oscillation of the stripes 7*a* of the aperture grille 7 below the permissive level, as will be noted from FIG. 13.

At this end, in the color picture tube of the third embodiment, a pair of pins 9*a* and 9*b* which are designed to engage a leaf spring 20 which support a horizontal member (upper one in FIG. 14A) of the frame 8, as shown in FIG. 14B, while the leaf spring 20 which support the frame 8 is formed with a pair of openings 10*a* and 10*b* in a manner corresponding to the pins 9*a* and 9*b*, as shown in FIG. 14C. In FIG. 14C, a cut 10*c* is formed in the end of the leaf spring 20 located toward the face panel 1 in order to form a pair of branches 10*e* and 10*f*, and a leaf spring also includes a bend 10*d*.

In the color picture tube of the third embodiment, six pins are mounted on the face panel 1, and leaf springs having different natural resonance behaviors such as leaf springs 10 and 20 are used to support the frame 8. By using leaf springs having different behaviors at the same time, the magnitude of the wobble at the resonant frequency can be suppressed small.

The aperture grille 7 of the third embodiment exhibits a distribution of resonant frequencies, which is similar to that shown in FIG. 10. In this manner, the points of resonance of the aperture grille 7 may be shifted out of the frequency values in the series described in connection with the first embodiment, allowing a color shift or the like in the image to be alleviated. The resonant frequency of the aperture grille 7 is also increased in the third embodiment, achieving a similar effect as described above in connection with the second embodiment.

Except for the other respects, the color picture tube according to the third embodiment is identical to that according to the first or second embodiment.

Fourth Embodiment

A color picture tube of a fourth embodiment is also an example of application of the approaches (3) and (1). The color picture tube of the fourth embodiment differs from the first to third embodiments only in respect of the material for the frame 8.

In the fourth embodiment, an adjustment which includes a resonant frequency $\omega_s$ of the aperture grille 7 is achieved by using different materials for the horizontal members (as shown at 8*a* and 8*b* in FIG. 2) and the vertical members (as shown at 8*c* and 8*d* in FIG. 2) of the frame 8. By way of example, the horizontal member is made of stainless steel (SUS410S), while the vertical member is made of chrome molybdenum steel (SCM445). A structure which is similar to that used in the first to third embodiments may also be used in the color picture tube of the fourth embodiment to establish a distribution of resonant frequencies of the aperture grille 7 which is located within the frequency band offset from the high contrast frequencies $\omega_c$, thus achieving a similar effects as achieved in the first to third embodiments.

Except for the other respects, the color picture tube according to the fourth embodiment is identical to that according to the first to third embodiments.

Fifth Embodiment

A color picture tube of a fifth embodiment is an example of application of the approach (2). However, it will be understood that the approach (2) may be used in combination with either one or both of the approaches (3) and (1) depending on various factors including the type of the color picture tube, the environment in which it is installed, the performance required for the color picture tube, and the like.

Figure 15:
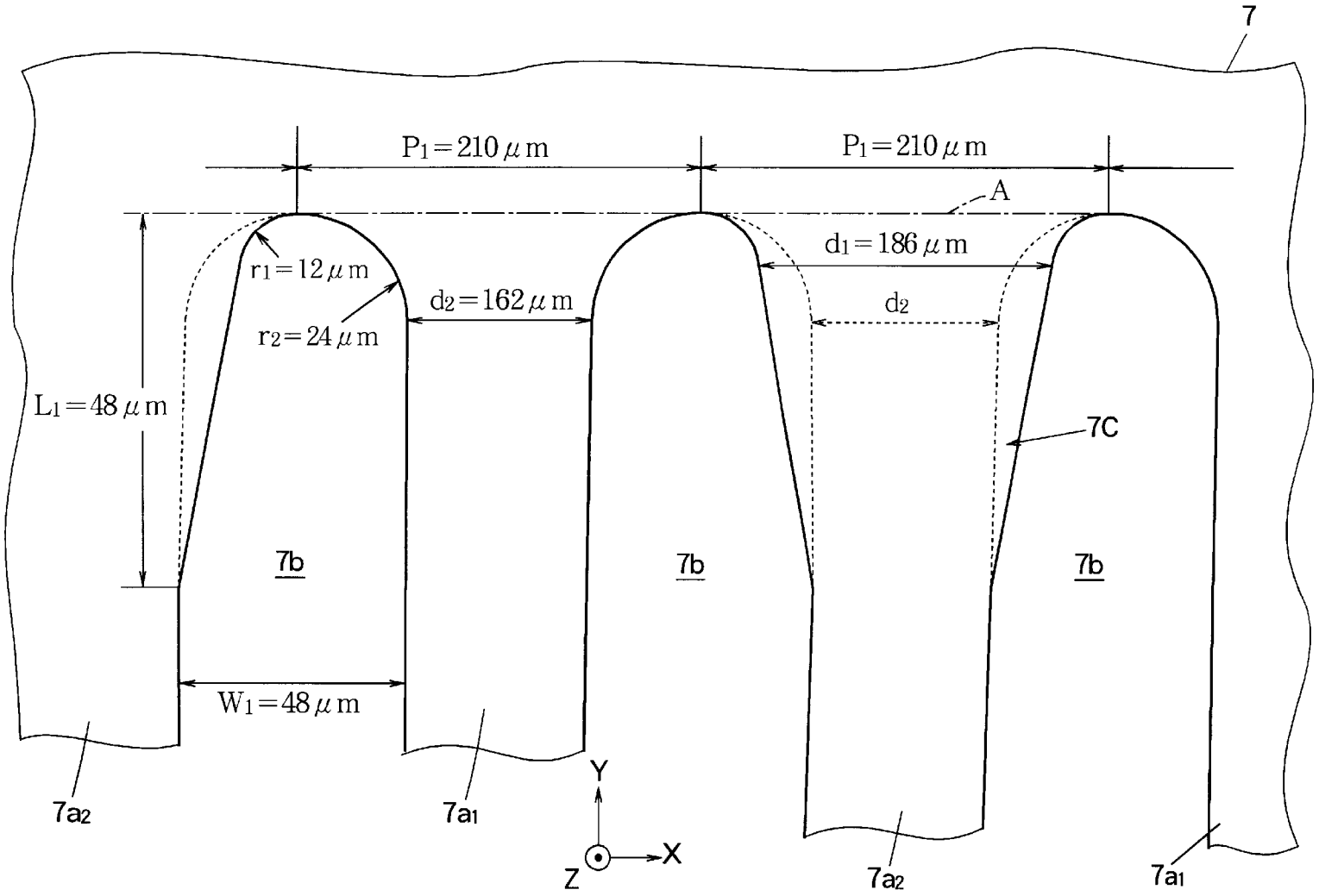
FIG. 15 is a view schematically showing widened areas of strips in an aperture grille of a color picture tube according to a fifth embodiment of the present invention.

FIG. 15 is a schematic view showing strips of an aperture grille of a color picture tube according to the fifth embodiment of the present invention. As shown in FIG. 15, in the color picture tube of the fifth embodiment, every other strip 7*a*1 and 7*a*2 of the aperture grille 7 has an end of a different width, as shown in FIG. 15. Specifically, even-numbered strips 7*a*1 have a constant width $d_2$, while odd-numbered strips 7*a*2 has a width which is increased toward its end to a greater width $d_1$ which is larger than the width $d_2$. The purpose of providing the strip 7*a*2 having a widened portion 7*c* is to provide a higher mechanical strengths than the strip 7*a*1 which is not provided with such a widened end 7*c*, thus making it less susceptible to oscillation. The widened end 7*c* is provided for every other strip 7*a*2 in order to alleviate a reduction in the luminance which is caused by the provision of the widened end 7*c*, which reduces the slit width to decrease the amount of electron beam reaching the phosphor. In another words, if the widened end 7*c* is provided at every strip 7*a*1 and 7*a*2, the luminance will be too much reduced. However, it is not always necessary that the widened end 7*cb* disposed at every other strip, and whenever a preference is given to increasing the strings of the strips, the number of strips on which the widened end 7*c* is provided may be increased.

As shown in FIG. 15, the widened end of the strip 7*a*2 may have a width $d_1$, which is a median value between a maximum width of 210 μm and a minimum width of 162 μm of the widened end, which is equal to 180 μm, for example, while the strip 7*a*1 has a constant width $d_2$ of 162 μm. The slits 7*b* may be disposed at a pitch $P_1$, which is also the pitch for the strips 7*a*, equal to 210 μm. A radius of curvature $r_1$ at the end of the slit 7*b* which faces the strip 7*a*2 having the widened end 7*c* is equal to 12 μm, while a radius of curvature $r_2$ at the end of the slit 7*b* which faces the strip 7*a*1 having no widened end 7*c* is equal to 24 μm. As measured from the end of the slit 7*b* the widened end 7*c* has a lengths $N_1$ of 48 μm. Thus, the lengths of the widened end 7*c* of the strip 7*a*2 is equal to 48 μm, which is also equal to the width of the slit 7*b*, and hence a reduction in the light output is little perceivable to human eye. While FIG. 15 shows the upper end of the aperture grille as viewed in the vertical direction (Y direction), a similar construction is also provided for the lower end of the aperture grille. In another words, the widened ends 7*c* are provided at both the upper and the lower end of the single strip 7*a*2.

It should be understood that the configuration and the size of the widened end 7*c* of the strip 7*a*2 is not limited to the one described above but that a variety of modifications are possible. However, it is desirable that the medium value between the maximum width (for example, 210 μm) and the minimum width (for example, 162 μm) of the widened end 7*c*, which may be 186 μm, for example, be greater than the width (162 μm) of the slit 7*b* by more than 10%.

In this manner, the magnitude of oscillation of the strips 7*a* of the aperture grille 7 is reduced in the color picture tube of the fifth embodiment, allowing a degradation in image quality which is attributable to oscillations to be alleviated.

Sixth Embodiment

A color picture tube of a sixth embodiment represents an example of adopting the approach (2). However, it should be understood that the approach (2) may be used in combination with either one or both of the approaches (3) and (1) depending on various factors including the type of the color picture tube, the environment in which it is installed, the performance required for the color picture tube, and the like.

Figure 16:
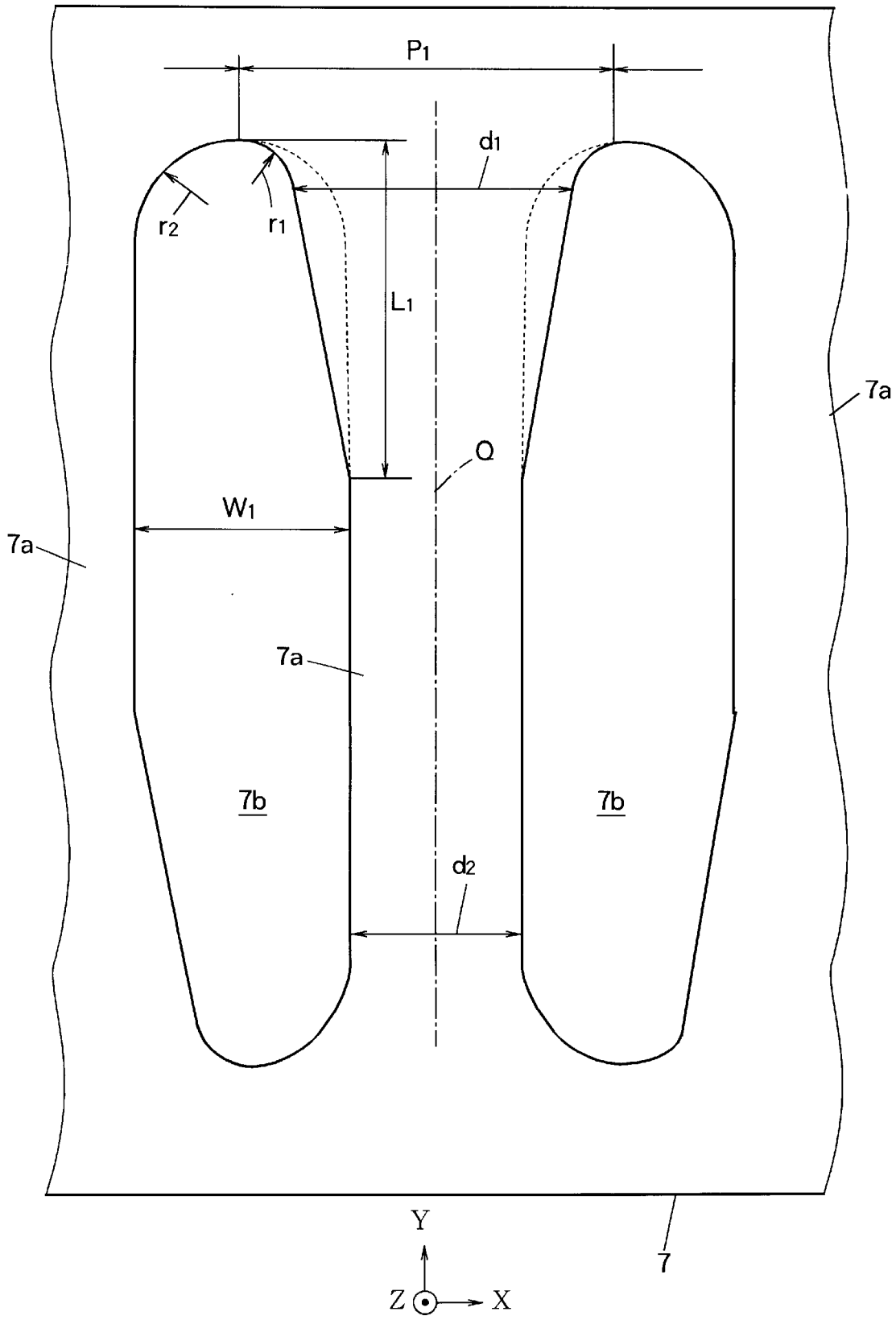
FIG. 16 is a view schematically showing strips of an aperture grille of a color picture tube according to a sixth embodiment of the present invention.

FIG. 16 is a schematic view showing a strip of an aperture grille of a color picture tube according to the sixth embodiment of the present invention. It is to be understood that in FIG. 16, the size in the longitudinal direction (Y direction) is compressed while the size in the lateral direction (X direction) is enlarged, and accordingly, the aspect ratio is different from that of an actual aperture grille 7.

In the color picture tube of the sixth embodiment, an odd-numbered strip 7*a* of the aperture grille 7 has a width $d_1$, while an even-numbered strip 7*a* of the aperture grille 7 has a width $d_2$, which is different from $d_1$. For example, $d_1$=186 μm, and $d_2$=162 μm. It is to be noted that the radii of curvature $r_1$ and $r_2$ of the ends of the slit 7*b*, the lengths $L_1$ of the widened end of the strip 7*a*, the maximum width $W_1$ of the slit 7B, the pitch $P_1$ between adjacent slits 7*b* remains the same values as in the fifth embodiment.

It is to be noted that the odd-numbered strip 7*a* has a widened end on the lower side thereof as viewed in FIG. 16, while the even-numbered strip 7*a* has a widened end on the upper side thereof as viewed in FIG. 16, and thus the strip 7*a* has a configuration which is asymmetrical as viewed in the up-and-down direction (Y direction). However, the configuration of the strip 7*a* is symmetrical with respect to a longitudinal center line Q of the strip 7*a*. When the position of the widened end is transposed for every other strip 7*a*, it is possible to improve the strings of the strip 7*a* while minimizing a reduction in the luminance.

It should be understood that the configuration of the size of the widened end of the strip 7*a* is not limited to the one mentioned above, but that a number of modifications are possible. However, it is desirable that the widened end has a lengths which is equal to or greater than the maximum width of the slit 7*b*, and the median value of the widened end (for example, 186 μm) between the maximum width (for example, 210 μm) and the minimum width (for example, 182 μm) be greater than the width (162 μm) of the strip 7*b* by more than 10%.

The magnitude of oscillation of the strip 7*a* of the aperture grille 7 is reduced in the color picture tube of the sixth embodiment, allowing a degradation in image quality which is attributable to oscillations to be alleviated. The described construction of the strip 7*a* is effective to prevent it from being twisted as it is tensioned in the Y direction and during a subsequent heat treatment step.

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. A color picture tube comprising:

a face panel which is provided with a fluorescent screen;

an electron gun for emitting an electron beam;

means for scanning the electron beam in a horizontal and a vertical direction;

a shadow mask having a plurality of openings and disposed in opposing relationship with the fluorescent screen;

a frame for supporting said shadow mask; and a support member for supporting said frame on said face panel;

wherein $\omega_v$ denotes a vertical scan frequency by said means for scanning, n denotes an arbitrary integer which satisfies $1 \leqq n \leqq 6$, N denotes an arbitrary integer which satisfies $1 \leqq N \leqq 6$, ω denotes a frequency which satisfies $\omega = \omega_v * n/N$, $\omega_s$ denotes a resonant frequency of said shadow mask, and said frame, said support member, and said shadow mask are constructed such that the resonant frequency $\omega_s$ assumes a value other than the frequency ω.

2. A color picture tube according to claim 1, wherein said shadow mask is an aperture grille having an array formed by a plurality of strips which are spaced apart from each other, the plurality of strips of the aperture grille being each supported by said frame only at both ends thereof.

3. A color picture tube according to claim 2, wherein:

the resonant frequency $\omega_s$ varies depending on a horizontal position on the aperture grille; and the aperture grille is constructed such that a difference $\Delta\omega_s$ between a maximum and a minimum value of the resonant frequency $\omega_s$ is equal to or less than 40 Hz when the frequency ω is equal to or greater than 350 Hz.

4. The color picture tube according to claim 2, wherein each strip of the aperture grille has a widened part at an end of the strip.

5. A color picture tube according to claim 1, wherein:

the resonant frequency $\omega_s$ varies depending on a horizontal position on said shadow mask; and said shadow mask is constructed such that a difference $\Delta\omega_s$ between a maximum and a minimum value of the resonant frequency $\omega_s$ is less than the vertical scan frequency $\omega_v$.

6. A color picture tube according to claim 1, wherein:

said frame comprises a first horizontal member and a second horizontal member which secure ends of said shadow mask, and a first vertical member and a second vertical member interconnected between the first and the second horizontal member; and the first horizontal member and the second horizontal member are formed of a material which is different from the material used for the first vertical member and the second vertical member.

7. A color picture tube according to claim 1, wherein:

said frame comprises a first horizontal member and a second horizontal member for securing ends of the shadow mask, and a first vertical member and a second vertical member interconnected between the first horizontal member and the second horizontal member; and said support member includes a leaf spring having one end connected to said frame and the other end connected to said face panel, at least one of the first horizontal member and the second horizontal member being connected to said face panel by two or more leaf springs functioning as said support member.

8. A color picture tube according to claim 7, wherein the two or more leaf springs connected to at least one of the first horizontal member and the second horizontal member are disposed adjacent to corners of said face panel.

9. A color picture tube according to claim 1, wherein:

said support member includes a plurality of leaf springs, each having one end connected to said frame and the other end connected to said face panel; and the plurality of leaf springs includes at least two different types of leaf springs each having different elastic behaviors.

10. A color picture tube according to claim 1, wherein:

said support members includes a plurality of leaf springs, each having one end connected to said frame and the other end connected to said face panel; and the plurality of leaf springs includes a leaf spring which is branched at one end thereof to form a first branch and a second branch, each of which is connected to said face panel.

11. A color picture tube comprising:

a face panel which is provided with a fluorescent screen;

an electron gun for emitting an electron beam;

means for scanning the electron beam in a horizontal and a vertical direction;

a shadow mask having a plurality of openings and disposed in opposing relationship with the fluorescent screen;

a frame for supporting said shadow mask; and a support member for supporting said frame on said face panel;

wherein $\omega_v$ denotes a vertical scan frequency by the means for scanning, n denotes an arbitrary integer which satisfies $1 \leqq n \leqq 7$, N denotes an arbitrary integer which satisfies $1 \leqq N \leqq 7$, $\omega$ denotes a frequency which satisfies $\omega = \omega_v * n/N$, $\omega_s$ denotes a resonant frequency of said shadow mask, and said frame, said support member and said shadow mask are constructed such that resonant frequency $\omega_s$ assumes a value other than frequency $\omega$.

12. A color picture tube according to claim 11, wherein said shadow mask is an aperture grille having an array formed by a plurality of strips which are spaced apart from each other, the plurality of strips of the aperture grille being each supported by said frame only at both ends thereof.

13. A color picture tube according to claim 12, wherein:

the resonant frequency $\omega_s$ varies depending on a horizontal position on the aperture grille; and the aperture grille is constructed such that a difference $\Delta\omega_s$ between a maximum and a minimum value of the resonant frequency $\omega_s$ is equal to or less than 40 Hz when the frequency $\omega$ is equal to or greater than 350 Hz.

14. A color picture tube according to claim 11, wherein:

the resonant frequency $\omega_s$ varies depending on a horizontal position on said shadow mask; and said shadow mask is constructed such that a difference $\Delta\omega_s$ between a maximum and a minimum value of the resonant frequency $\omega_s$ is less than the vertical scan frequency $\omega_v$.

15. A color picture tube according to claim 11, wherein:

said frame comprises a first horizontal member and a second horizontal member which secure ends of said shadow mask, and a first vertical member and a second vertical member interconnected between the first and the second horizontal member; and the first horizontal member and the second horizontal member are formed of a material which is different from the material used for the first vertical member and the second vertical member.

16. A color picture tube according to claim 11, wherein:

said frame comprises a first horizontal member and a second horizontal member for securing ends of the shadow mask, and a first vertical member and a second vertical member interconnected between the first horizontal member and the second horizontal member; and said support member includes a leaf spring having one end connected to the frame and the other end connected to said face panel, at least one of the first horizontal member and the second horizontal member being connected to said face panel by two or more leaf springs functioning as said support member.

17. A color picture tube comprising:

a face panel which is provided with a fluorescent screen;

an electron gun for emitting an electron beam;

means for scanning the electron beam in a horizontal and a vertical direction;

an aperture grille including a plurality of strips disposed in an array and separated from each other by a slit and disposed in opposing relationship with the fluorescent screen; and a frame supported by said face panel for supporting the plurality of strips of said aperture grille at an end thereof;

wherein each strip of said aperture grille has a widened part at an end of the strip.

18. A color picture tube according to claim 17, wherein the widened part has a length as measured lengthwise of the strip which is equal to or greater than the width of the slit.

19. A color picture tube according to claim 17, wherein the widened part is formed for every other one of the plurality of strips.

20. A color picture tube according to claim 17, wherein the widened part is formed only at one end of the strip.

* * * * *